US008945479B2

(12) United States Patent
Ono

(10) Patent No.: US 8,945,479 B2
(45) Date of Patent: Feb. 3, 2015

(54) MICROCHANNEL CHIP AND MICROANALYSIS SYSTEM

(75) Inventor: Koichi Ono, Saitama (JP)

(73) Assignee: Enplas Corporation, Saitama (JP)

( * ) Notice: Subject to any disclaimer, the term of this patent is extended or adjusted under 35 U.S.C. 154(b) by 48 days.

(21) Appl. No.: 13/812,315

(22) PCT Filed: Jul. 15, 2011

(86) PCT No.: PCT/JP2011/004055

§ 371 (c)(1),
(2), (4) Date: Jan. 25, 2013

(87) PCT Pub. No.: WO2012/014405

PCT Pub. Date: Feb. 2, 2012

(65) Prior Publication Data

US 2013/0121877 A1 May 16, 2013

(30) Foreign Application Priority Data

Jul. 26, 2010 (JP) ..... 2010-167227

(51) Int. Cl.
*B01L 3/00* (2006.01)

(52) U.S. Cl.
CPC ..... *B01L 3/5027* (2013.01); *B01L 3/502707* (2013.01); *B01L 3/502715* (2013.01); *B01L 2300/0887* (2013.01); *B01L 2200/027* (2013.01); *B01L 2300/0654* (2013.01); *B01L 2300/0816* (2013.01)
USPC ..... 422/503; 422/502; 422/507; 422/524; 422/525

(58) Field of Classification Search
None
See application file for complete search history.

(56) References Cited

U.S. PATENT DOCUMENTS

| | | | | |
|---|---|---|---|---|
| 2002/0117517 | A1 | 8/2002 | Unger et al. | |
| 2002/0176804 | A1 * | 11/2002 | Strand et al. | 422/100 |
| 2005/0260745 | A1 | 11/2005 | Domansky et al. | |
| 2007/0272001 | A1 * | 11/2007 | Arnold | 73/53.01 |
| 2008/0031790 | A1 | 2/2008 | Ohta et al. | |
| 2008/0267845 | A1 | 10/2008 | Hoglund et al. | |
| 2009/0266421 | A1 * | 10/2009 | Linder et al. | 137/1 |
| 2010/0045147 | A1 | 2/2010 | Harnack et al. | |
| 2011/0223496 | A1 | 9/2011 | Makita et al. | |

FOREIGN PATENT DOCUMENTS

| | | | |
|---|---|---|---|
| JP | 09-236540 | A | 9/1997 |
| JP | 2005-257017 | A | 9/2005 |
| JP | 2007-537759 | A | 12/2007 |
| JP | 2008-023406 | A | 2/2008 |
| JP | 2009-063429 | A | 3/2009 |
| JP | 2009-524508 | A | 7/2009 |
| JP | 2009-541038 | A | 11/2009 |
| WO | 2008/053660 | A1 | 5/2008 |

* cited by examiner

*Primary Examiner* — Jill Warden
*Assistant Examiner* — Timothy G Kingan
(74) *Attorney, Agent, or Firm* — Brundidge & Stanger, P.C.

(57) ABSTRACT

Disclosed is a microchannel chip having an opening on the side of a plate with a lowered production cost. In the microchannel chip, a first plate (11), to which a third concavity (17) opening at one side surface (13) and a joining surface (14) is formed on the joining surface (14), is joined to a second plate (21), to which a sixth concavity (26) opening at one side surface (23) is formed on the joining surface and a groove (27') interconnecting with the sixth concavity (26) is formed. The third concavity (17) and the sixth concavity (26) are aligned facing each other, and by the third concavity (17) and the sixth concavity (26), a glass tube introducing opening (33) is formed having a wider width than that of a duct (27). An adhesive agent is injected into the glass tube introducing opening (33) and a glass tube is inserted.

4 Claims, 9 Drawing Sheets

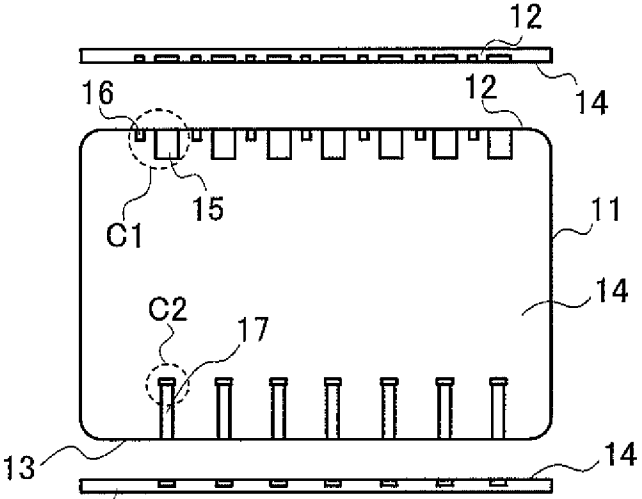
FIG. 1B
FIG. 1A
FIG. 1C
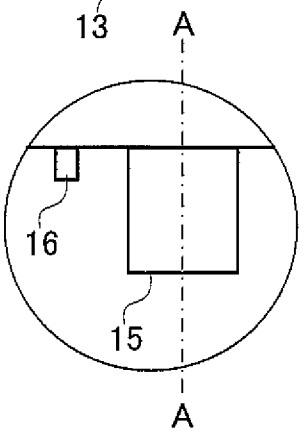
FIG. 1D
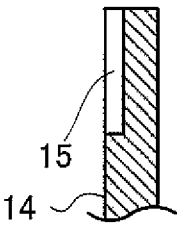
FIG. 1E
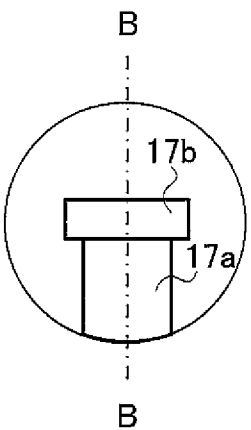
FIG. 1F
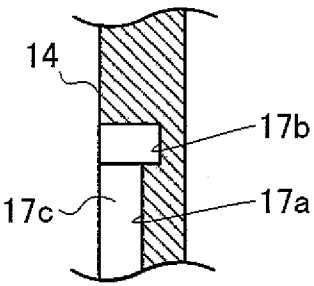
FIG. 1G

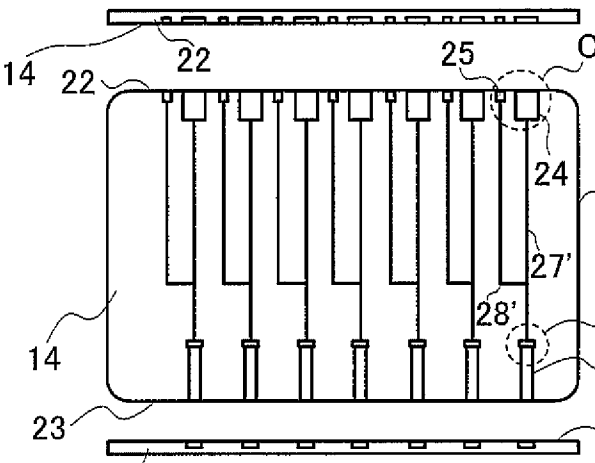
FIG. 2B
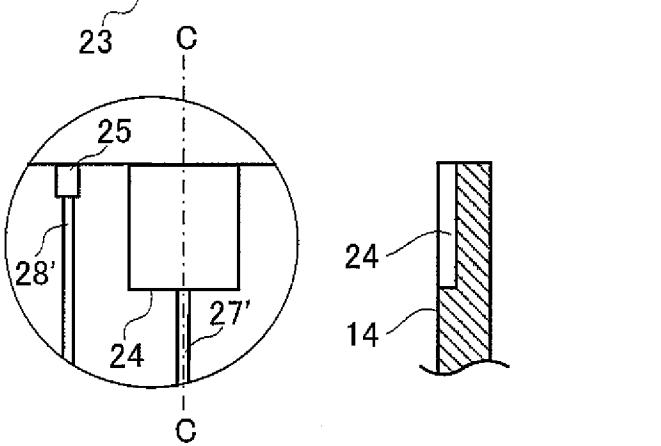
FIG. 2A
FIG. 2C
FIG. 2D
FIG. 2E
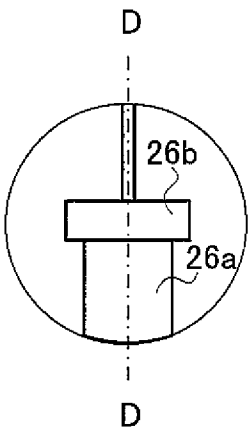
FIG. 2F
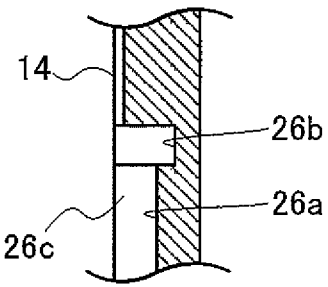
FIG. 2G

MICROCHANNEL CHIP AND MICROANALYSIS SYSTEM

TECHNICAL FIELD

The present invention relates to a micro flow path chip made of a resin substrate having a micro flow path therein and a micro analysis system.

BACKGROUND ART

In a current scientific field or a medical field such as biochemistry and analytical chemistry, a micro analysis system being employed for rapidly testing and analyzing a small amount of protein or nucleic acid (for example, DNA) with accuracy.

As such a micro analysis system, Patent literature 1 discloses, for example, an insert for a laboratory vessel, as a system for storing a plurality of samples, having a plurality of reception cavities into which laboratory vessels including samples can be inserted. Patent literature 1 also discloses reception cavities having flow paths for helping washing of samples in the inserted laboratory vessel or a rinse process, the flow paths having reduced diameters and opening toward a bottom.

Patent literature 2 discloses a configuration of attaching a connection part to a flow plate of a multipurpose flow module and introducing fluid samples subjected to analysis into a flow path of the flow plate.

CITATION LIST

Patent Literature

PLT 1

Japanese Translation of a PCT Application Laid-Open No. 2009-541038

PLT 2

Japanese Translation of a PCT Application Laid-Open No. 2009-524508

SUMMARY OF INVENTION

Technical Problem

However, a mold structure is complex and forming is more difficult in integral forming of resin products having a recessed part deeply recessed from an opening, such as the reception cavity disclosed in the above-described Patent literature 1, or resin products having both a recessed part provided with an opening having a relatively large cross-section area and a flow path corresponding to the recessed part and having a small cross-section area. The connection part attached to a flow plate disclosed in the above-described Patent literature 2 is a member having a tubular structure having a plurality of regions having different inner diameters. A mold structure is complex as with the laboratory vessel insert disclosed in Patent literature 1, in forming of a member having such a shape with resin or integral forming of the above-described connection part and the flow plate. In view of the above, a product having an opening on the side surface of a plate and forming a flow path corresponding to the opening causes a soaring cost of the product in association with a complex mold structure.

It is an object of the present invention to provide a micro flow path chip which has an opening on the side surface of a plate and can reduce a product cost, and a micro analysis system.

Solution to Problem

A micro flow path chip according to the present invention is a micro flow path chip including an assembly of a first thin plate and a second thin plate, further including: a first recessed part having an opening formed on a joint surface and a side surface of the first plate; and a second recessed part and a groove formed on a joint surface of the second plate, the second recessed part having an opening on the joint surface and a side surface of the second plate, the groove having a smaller size in a width direction and a depth direction than the second recessed part in a cross section parallel to the side surface, wherein: the first recessed part and the second recessed part have no undercut part such that each of the first and second recessed parts has a shape of a cross section parallel to the joint surface, and the shape of the cross section does not change or decrease as the cross section is away from the joint surface; and the first recessed part of the first plate faces and is joined to the second recessed part of the second plate to form a side opening region being a recess which opens on the side surface and a flow path formed by closing the groove with the joint surface of the first plate.

The micro analysis system according to the present invention employs a configuration to include the above-described micro flow path chip.

Advantageous Effects of Invention

According to the present invention, it is possible to provide a micro flow path chip which has an opening on the side surface of a plate and can reduce a product cost, and a micro analysis system.

BRIEF DESCRIPTION OF DRAWINGS

FIG. 1 is a diagram showing the shape of the first plate configuring a micro flow path chip according to Embodiment 1 of the present invention;

FIG. 2 is a diagram showing the shape of the second plate configuring the micro flow path chip according to Embodiment 1 of the present invention;

DESCRIPTION OF EMBODIMENTS

Figure 3B:
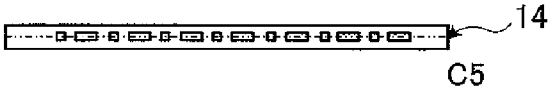
FIG. 3 is a diagram showing the shape of the micro flow path chip according to Embodiment 1 of the present invention.
Figure 3A:
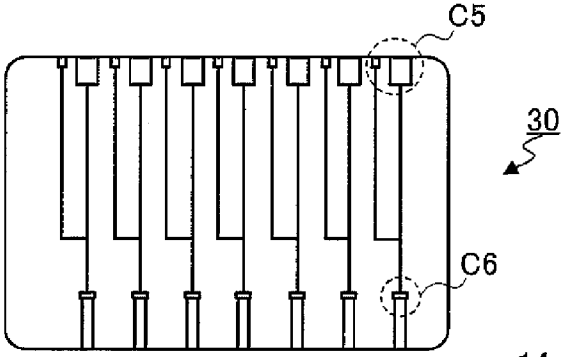
Figure 3C:
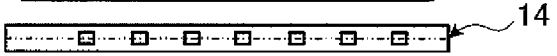
Figure 3D:
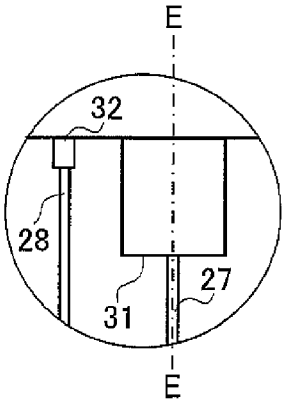
Figure 3E:
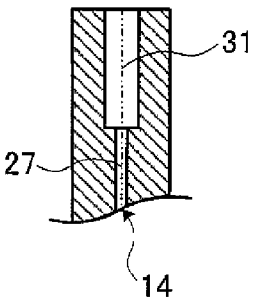
Figure 3F:
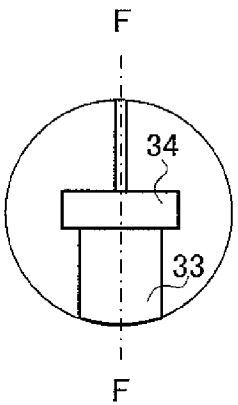
Figure 3G:
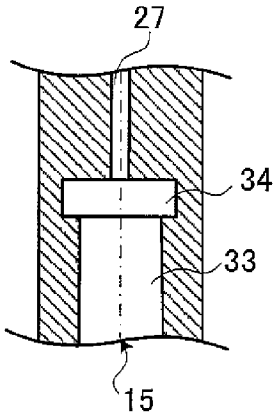

Embodiments of the present invention will now be described in detail with reference to the drawings.

Embodiment 1

In Embodiment 1 of the present invention, a micro flow path chip formed by joining two plates will be described.

FIG. 1 is a diagram showing the shape of first plate 11 configuring a micro flow path chip according to Embodiment 1 of the present invention. FIG. 1A is a plane view showing the shape of first plate 11. FIG. 1B is a side view showing the positions of first recessed parts 15 and second recessed parts 16 in first plate 11. FIG. 1C is a side view showing the positions of third recessed parts 17 in first plate 11. FIG. 1D is an enlarged view showing a part framed by dotted circle C1 in FIG. 1A. FIG. 1E is a cross-section view taken by line A-A in FIG. 1D. FIG. 1F is an enlarged view showing a part framed by dotted circle C2 in FIG. 1A. FIG. 1G is a cross-section view taken by line B-B in FIG. 1F.

In order to avoid explanations in overlapping components, reference numerals are assigned to representative components and the components will be explained in drawings and the following explanations.

First plate 11 is formed with a planar plate of a resin material and has pluralities of first recessed parts 15 and second recessed parts 16 which open on one side surface 12 (an upper side surface in the drawing) and joint surface 14.

First plate 11 has a plurality of third recessed parts 17 which open on the other side surface 13 (the lower side surface in the drawing) and joint surface 14 and are arranged at the positions opposite to the plurality of first recessed parts 15.

First to third recessed parts 15 to 17 have quadrangular cross-sections parallel to side surfaces 12 and 13. Considering that first to third recessed parts 15 to 17 are recessed from joint surface 14 as a reference surface, each of these recessed parts has a bottom, an opening edge on a side surface, an edge opposite to the opening edge on the side surface, and inner walls extending from the bottom toward joint surface 14. Each of third recessed parts 17 has a region having a larger depth (the distance from joint surface 14 to a bottom) and width (the distance between facing inner walls) compared to bottom 17*a* and inner walls 17*c* adjacent to the opening edge on the side surface, in the opposite to the opening edge on the side surface, and has bottom 17*b* and inner walls 17*c*. These recessed parts 15 to 17 have no part widening from the opening of joint surface 14 to a bottom, and the shapes of the cross-sections in the recessed parts parallel to joint surface 14 are the substantially same at any position according to the present embodiment.

FIG. 2 is a diagram showing the shape of second plate 21 configuring a micro flow path chip according to Embodiment 1 of the present invention. FIG. 2A is a plane view showing the shape of second plate 21. FIG. 2B is a side view showing the positions of fourth recessed parts 24 and fifth recessed parts 25 in second plate 21. FIG. 2C is a side view showing the positions of sixth recessed parts 26 in second plate 21. FIG. 2D is an enlarged view showing a part framed by dotted circle C3 in FIG. 2A. FIG. 2E is a cross-section view taken by line C-C in FIG. 2D. FIG. 2F is an enlarged view showing a part framed by dotted circle C4 in FIG. 2A. FIG. 2G is a cross-section view taken by line D-D in FIG. 2F.

In order to avoid explanations in overlapping components, reference numerals are assigned to representative components and the components will be explained in drawings and the following explanation.

Second plate 21 is made of a planar resin material and has pluralities of fourth recessed parts 24 and fifth recessed parts 25 which open on one side surface 22 (an upper side surface in the drawing) and joint surface 14.

Second plate 21 has a plurality of sixth recessed parts 26 which open on the other side surface 23 (the lower side surface in the drawing) and joint surface 14 and are arranged at the positions opposite to the plurality of fourth recessed parts 24.

Second plate 21 has grooves 27' communicating fourth recessed parts 24 with respective sixth recessed parts 26 and grooves 28' communicating fifth recessed parts 25 with respective grooves 27'. The widths of grooves 27' and 28' are narrower than those of fourth to sixth recessed parts 24 to 26.

Fourth to sixth recessed parts 24 to 26 have quadrangular cross-sections parallel to side surfaces 22 and 23. When fourth to sixth recessed parts 24 to 26 are recessed from joint surface 14 as a reference surface, each of these recessed parts has a bottom, an opening edge on a side surface, an edge opposite to the opening edge on the side surface, and inner walls extending from the bottom toward joint surface 14. Each of sixth recessed parts 26 has a region having a larger depth (the distance from joint surface 14 to a bottom) and width (the distance between facing inner walls) compared to bottom 26*a* and inner walls 26*c* adjacent to the opening edge on the side surface, in the opposite to the opening edge on the side surface, and has bottom 26*b* and inner walls 26*c*. These recessed parts 24 to 26 have no part widening from the opening of joint surface 14 to a bottom, and the shapes of cross-sections in the recessed parts parallel to joint surface 14 are the substantially same at any position according to the present embodiment.

FIG. 3 is a diagram showing the shape of micro flow path chip 30 according to Embodiment 1 of the present invention. FIG. 3A is a plane view showing the shape of micro flow path chip 30. FIG. 3B is a side view showing positions of fluid introducing ports 31 as side opening regions in micro flow path chip 30. FIG. 3C is a side view showing positions of glass tube introducing ports 33 as side opening regions in micro flow path chip 30. FIG. 3D is an enlarged view showing a part framed by dotted circle C5 in FIG. 3A. FIG. 3E is a cross-section view taken by line E-E in FIG. 3D. FIG. 3F is an enlarged view showing a part framed by dotted circle C6 in FIG. 3A. FIG. 3G is a cross-section view taken by line F-F in FIG. 3F.

Micro flow path chip 30 is formed by joining first plate 11 shown in FIG. 1 to second plate 21 shown in FIG. 2 on joint surface 14. First recessed parts 15, second recessed parts 16, and third recessed parts 17 in first plate 11 respectively face fourth recessed parts 24, fifth recessed parts 25, and sixth recessed parts 26 in second plate 21. First recessed parts 15 and fourth recessed parts 24 form respective fluid introducing ports 31 as side opening regions. Third recessed parts 17 and sixth recessed parts 26 form glass tube introducing ports 33 as side opening regions and connection parts 34 as wider regions connecting glass tube introducing ports 33 to flow paths 27.

Openings of groove 27' and groove 28' are closed by joint surface 14 of first plate 11 to form flow paths 27 and 28.

First plate 11 and second plate 21 are joined, for example, through adhesion with an organic adhesive, and thermal compression bond.

First plate 11 and second plate 21 are formed of resin material having a high light-permeability such as acryl, polycarbonate, and polyolefin, and are desirably made of the same materials.

A glass tube is inserted into the glass tube introducing port and then the appropriate amount of an adhesive is injected into a gap between the glass tube and the inner wall of the glass tube introducing port. The injected adhesive is introduced into the back of glass tube introducing port 33 by capillary attraction. The adhesive flows in the gap between the glass tube and the inner wall of glass tube introducing port 33, is introduced into the back of glass tube introducing port 33, and reaches the entry of connection part 34. At this time, the adhesive flowing into connection part 34 can be blocked by capillary repulsion since the gap between the glass tube and the inner wall of connection part 34 is drastically expanded. Accordingly, the inserted glass tube can be fixed without a flow of the adhesive into a flow path.

According to Embodiment 1, a micro flow path chip is formed by dividing the micro flow path chip into two plates in the thickness direction of a plate and joining the joint surfaces of the two plates. The micro flow path chip has side opening regions which have openings on the side surface of the plate and flow paths in communication with the side opening regions. This can reduce a manufacturing cost of the micro flow path chip. Accordingly, forming a recessed part with two divided plates can reduce the depth from the joint surface in the recessed part, compared to a case of forming a side opening region in one plate as one recessed part. This can reduce the height of protrusion as well in the surface forming a cavity of a mold. Accordingly, it is possible to make manufacturing of mold pieces and forming of a plate easier. When a shallow recessed part obtained by dividing a side opening region into two regions and a groove forming a flow path are formed on the same joint surface, mold pieces for the joint surface can be integrated in a complex shape. The part corresponding to the recessed part and the groove can be formed through the same process such as electrocasting. A joint surface of a micro flow path chip which is formed using an integrated piece can obtain a higher positional accuracy than a joint surface formed by combining a plurality of pieces.

When the side opening region is used as a fluid introducing port as shown in Embodiment 1, the side opening region formed by second recessed part 16 of first plate 11 and fifth recessed part 25 of second plate 21 can be used as an outlet for discharging air. In other words, it is possible to discharge air in a flow path which is excluded by introduction of fluid injected from a fluid introducing port, to the exterior from the outlet for discharging air.

Although it is easy to join two recessed parts obtained by dividing each of side opening regions which have large widths, it is difficult to determine a position when dividing each of flow paths having small widths into two and joining them, in a micro flow path chip having pluralities of side opening regions and flow paths. However, it is possible to easily determine a position in the joint of two plates by forming a side opening region which has a larger size and width in the direction of plate thickness than those of a flow path, with two divided plates, forming recessed parts on a joint surface, and forming a groove forming the flow path in only one of the plates, according to Embodiment 1 of the present invention.

According to Embodiment 1, a micro flow path chip has a side opening region having an opening on a side surface of a plate, a wider region having a larger cross-section area parallel to the side surface than an area of the opening, and a flow path in communication with the side opening region through the wider region, and is formed by dividing the micro flow path chip into two plates in the thickness direction of a plate and joining joint surfaces of the two plates. This can reduce a manufacturing cost of the micro flow path chip. Accordingly, forming a recessed part by dividing each of side opening region and the wider region into two on the two plates can reduce the depth of the recessed part from a joint surface compared to a case of forming each of the side opening region and the wider region in one plate as one recessed part. This can reduce the height of protrusion as well in a surface forming cavity of a mold, thereby making the manufacturing of mold pieces and forming of a plate easier. When a shallow recessed part obtained by dividing each of the side opening region and the wider region into two and a groove forming a flow path are formed on the same joint surface, mold pieces for the joint surface can be integrated in a complex shape. The part corresponding to the recessed part and the groove can be formed through the same process such as electrocasting. A joint surface of a micro flow path chip which is formed using an integrated piece can obtain a higher positional accuracy than a joint surface formed by combining a plurality of pieces.

When the side opening region is used as a glass tube introducing port as shown in Embodiment 1, it is possible to prevent the flow of the adhesive injected in a gap between an inner wall of the side opening region and a glass tube in the wider region. Consequently, entry of the adhesive into the flow path can be prevented.

It is difficult to integrally form a micro flow path chip having a wider region having a large cross-section area parallel to a side surface between a side opening region and a flow path. However, according to the present invention, such a micro flow path chip can be easily formed by joining two plates.

Embodiment 2

A case has been described where the side opening region formed on the side surface of the plate is used as a glass tube introducing port in Embodiment 1. A case will be described where the side opening region is used as an optical fiber introducing port, assuming that fluorescence in adjacent points in multi-point detection are simultaneously measured in Embodiment 2.

Figure 4A:
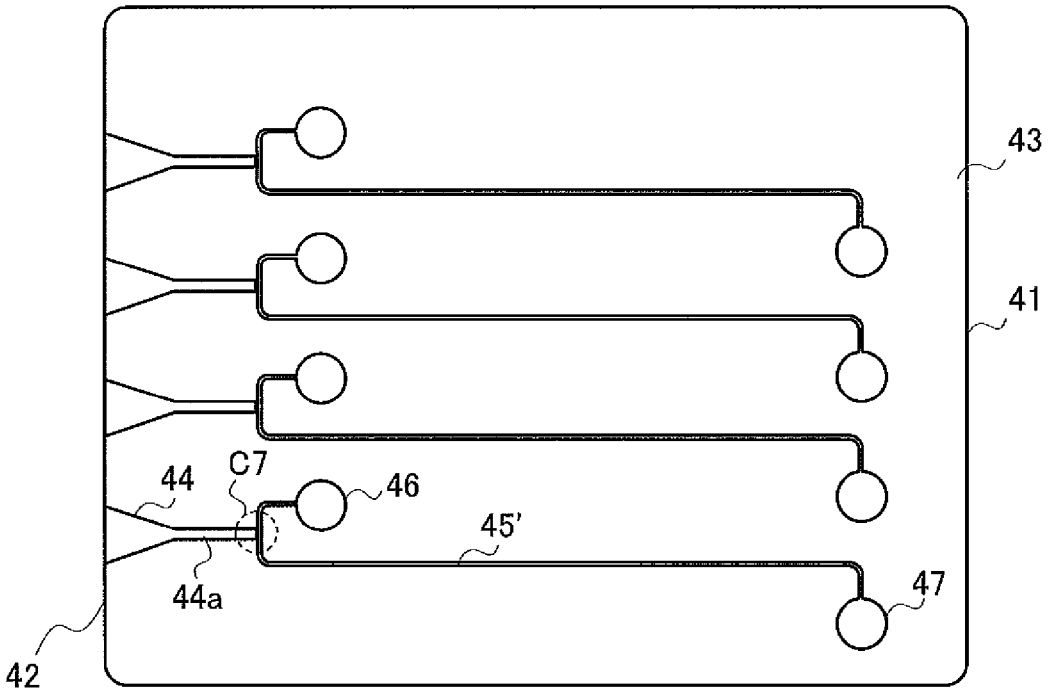
FIG. 4 is a diagram showing the shape of the first plate configuring a micro flow path chip according to Embodiment 2 of the present invention.
Figure 4B:
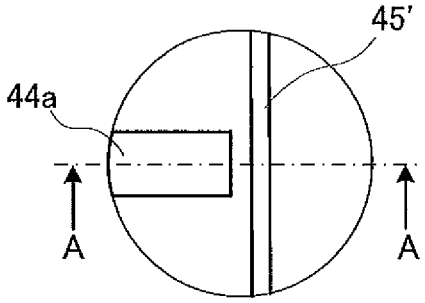
Figure 4C:
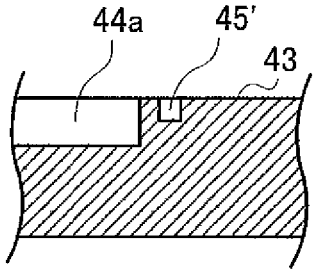

FIG. 4 is a diagram showing the shape of first plate 41 configuring a micro flow path chip according to Embodiment 2 of the present invention. FIG. 4A is a plane view showing the shape of first plate 41. FIG. 4B is an enlarged view showing a part framed by dotted circle C7 in FIG. 4A. FIG. 4C is a cross-section view taken by line A-A in FIG. 4B.

In order to avoid explanations in overlapping components, reference numerals are assigned to representative components and the components will be explained in drawings and the following explanation.

First plate 41 has a plurality of first recessed parts 44 which open on one side surface 42 (the side surface in the left side in the drawing) and joint surface 43. Each of first recessed parts 44 is a triangle of which the width gradually decreases from one side surface 42 to the center, and communicates with rectangular groove 44*a*, around the apex in the part of triangle of which the width decreases.

First plate 41 has grooves 45', each groove 45' adjoining to the apex of first recessed part 44, and having through holes 46' and 47' respectively corresponding to ports 46 and 47 for injecting samples and migration solution in both ends of groove 45'.

Figure 5A:
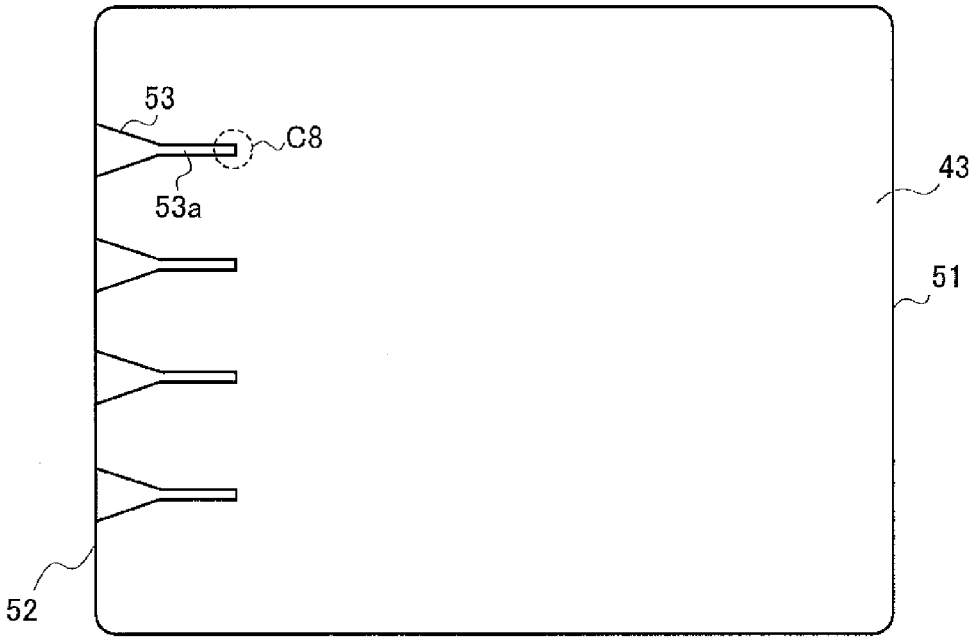
FIG. 5 is a diagram showing the shape of the second plate configuring the micro flow path chip according to Embodiment 2 of the present invention.
Figure 5B:
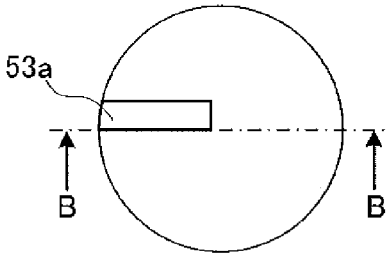
Figure 5C:
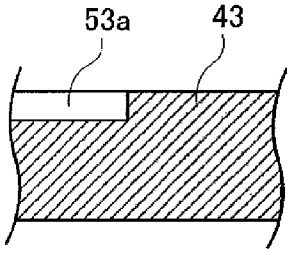

FIG. 5 is a diagram showing the shape of second plate 51 configuring a micro flow path chip according to Embodiment 2 of the present invention. FIG. 5A is a plane view showing the shape of second plate 51. FIG. 5B is an enlarged view showing a part framed by dotted circle C8 in FIG. 5A. FIG. 5C is a cross-section view taken by line B-B in FIG. 5B.

In order to avoid explanations in overlapping components, reference numerals are assigned to representative components and the components will be explained in drawings and the following explanation.

Second plate 51 has a plurality of second recessed parts 53 which open on one side surface 52 (the side surface in the left side in the drawing) and joint surface 43. Each of second recessed parts 53 is a triangle of which the width gradually decreases from the one side surface to the center, and communicates with rectangular groove 53*a*, around the apex in the part of triangle of which the width decreases.

Figure 6:
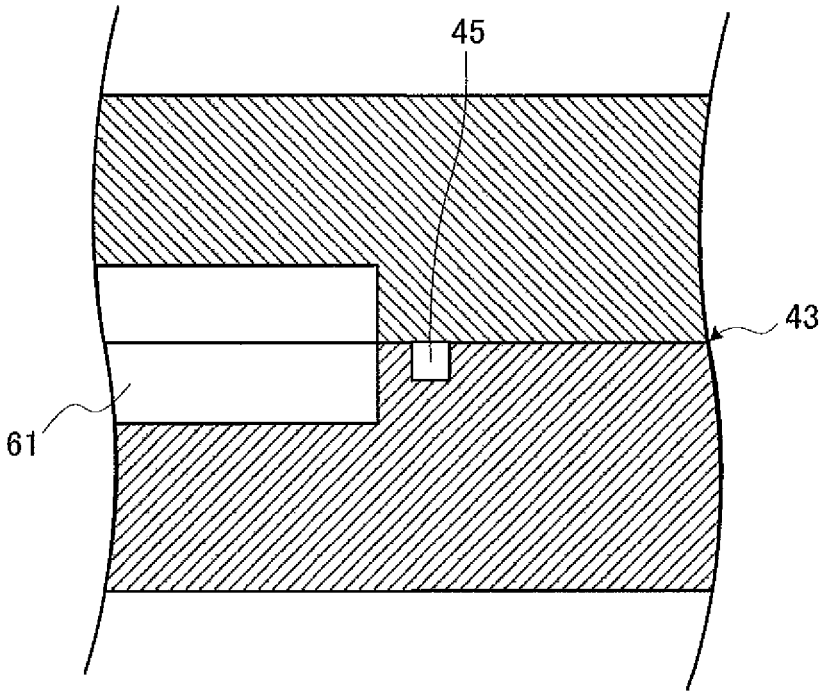
FIG. 6 is a cross-section view taken by line A-A in FIG. 4B in a state in which first plate 41 and second plate 51 are joined.

FIG. 6 is a cross-section view taken by line A-A in FIG. 4B in a state in which first plate 41 and second plate 51 are joined.

A micro flow path chip is formed by joining first plate 41 shown in FIG. 4 to second plate 51 shown in FIG. 5. First recessed parts 44 of first plate 41 face respective second recessed parts 53 of second plate 51. First recessed parts 44 and second recessed parts 53 form respective optical fiber introducing ports 61 as side opening regions. Grooves 45' and through holes 46' and 47' are closed by the joint surface of second plate 51 to form respective flow paths 45 and ports 46 and 47 respectively.

According to Embodiment 2, a micro flow path chip is formed by dividing the micro flow path chip into two plates in the thickness direction of a plate and joining the joint surfaces of two plates. The micro flow path chip has side opening regions which have openings on the side surface of the plate and flow paths located close to the side opening regions. This can reduce a manufacturing cost of the micro flow path chip. Accordingly, forming a recessed part with two divided plates can reduce the depth from a joint surface in the recessed part, compared to a case of forming the side opening region in one plate as one recessed part. This can reduce the height of protrusion as well in the surface forming a cavity of a mold, thereby making manufacturing of mold pieces and forming of a plate easier. When a shallow recessed part obtained by dividing a side opening region into two regions and a groove forming a flow path are formed on the same joint surface, mold pieces for the joint surface can be integrated in a complex shape. The part corresponding to the recessed part and the groove can be formed through the same process such as electrocasting. A joint surface of a micro flow path chip which is formed using an integrated piece can obtain a higher positional accuracy than a joint surface formed by combining a plurality of pieces.

When the side opening region is used as an optical fiber insert as shown in Embodiment 2, positions of a detecting portion in a flow path and an end of an optical fiber can be determined with high accuracy.

Another Embodiment

The present invention is applicable besides the glass tube introducing port and the optical fiber introducing port. The side opening region provided in a plate may be formed on the side surface of the plate as a projecting part and used as a tube connecter as shown FIGS. 7 to 9.

Figure 7A:
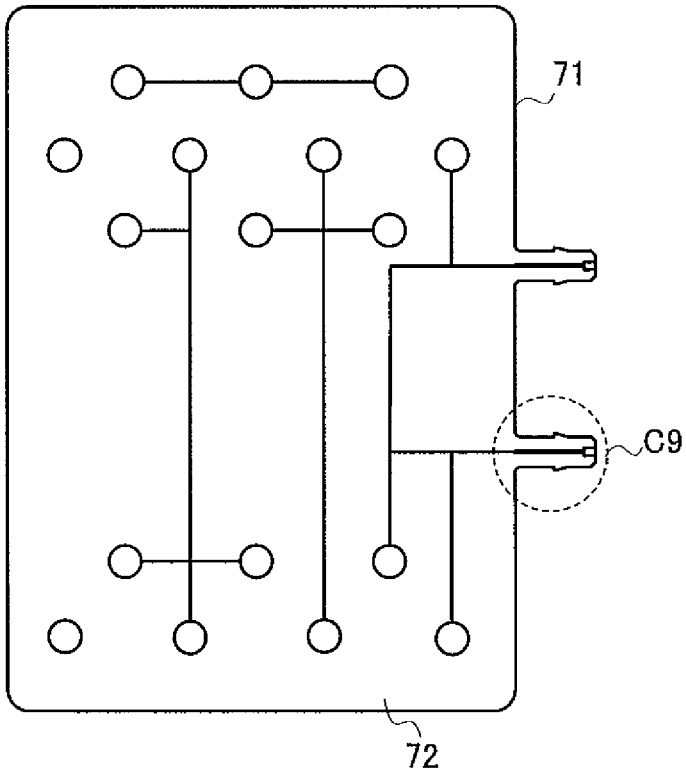
FIG. 7 is a diagram showing the shape of the first plate configuring a micro flow path chip having projecting parts according to another embodiment of the present invention.
Figure 7B:
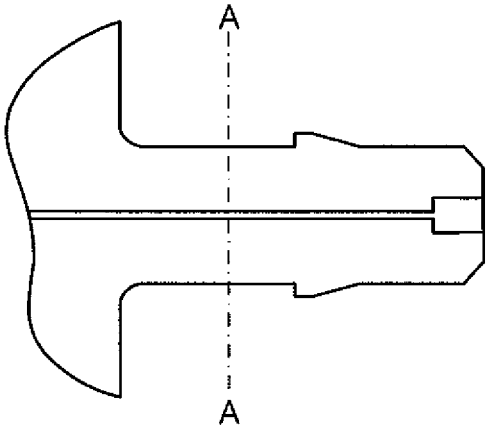
Figure 7C:
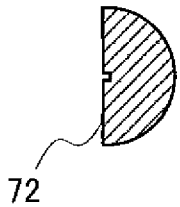

FIG. 7 is a diagram showing the shape of first plate 71 configuring a micro flow path chip having a projecting part according to another embodiment of the present invention. FIG. 7A is a plane view showing the shape of first plate 71. FIG. 7B is an enlarged view showing a part framed by dotted circle C9 in FIG. 7A. FIG. 7C is a cross-section view taken by line A-A in FIG. 7B.

Figure 8A:
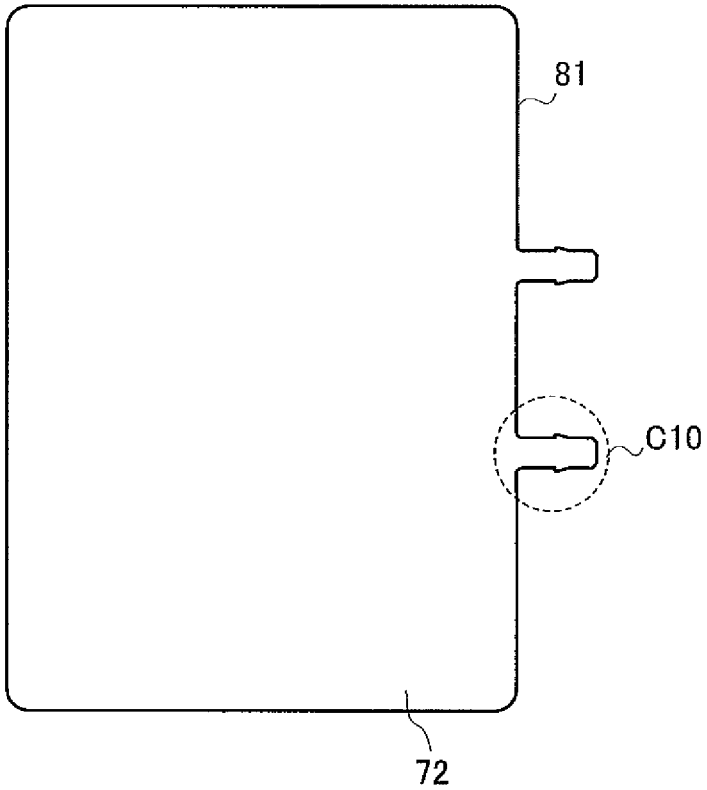
FIG. 8 is a diagram showing the shape of the second plate configuring the micro flow path chip having the projecting part according to the other embodiment of the present invention.
Figure 8B:
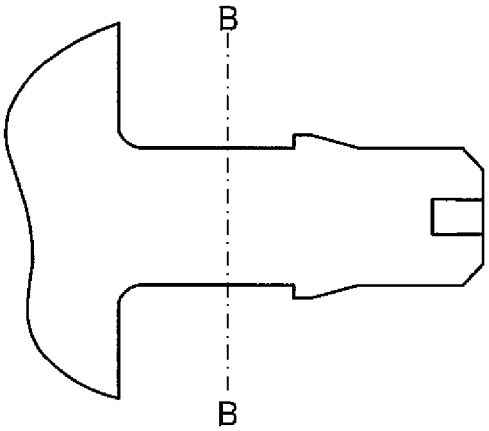
Figure 8C:
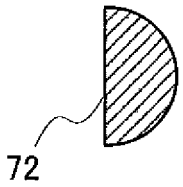

FIG. 8 is a diagram showing the shape of second plate 81 configuring a micro flow path chip having the projecting part according to the other embodiment of the present invention. FIG. 8A is a plane view showing the shape of second plate 81. FIG. 8B is an enlarged view showing a part framed by dotted circle C10 in FIG. 8A. FIG. 8C is a cross-section view taken by line B-B in FIG. 8B.

Figure 9A:
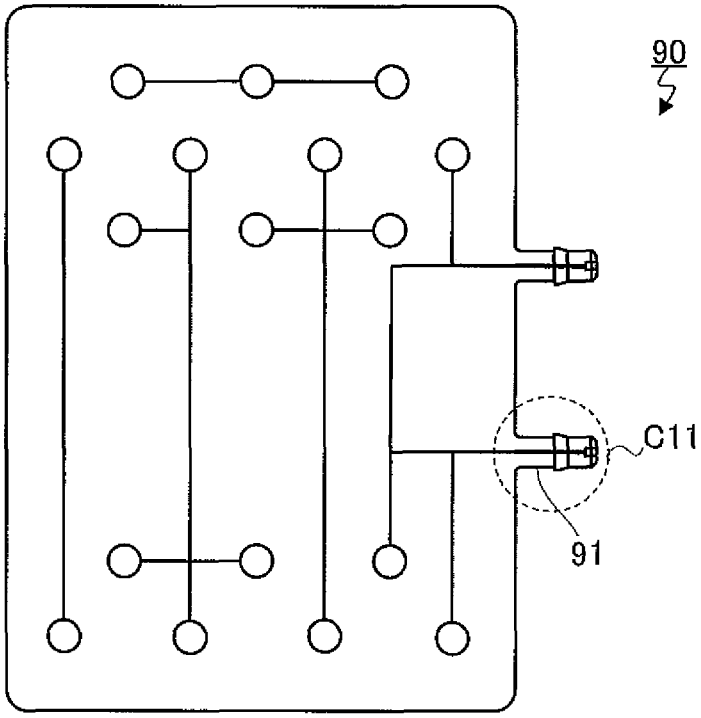
FIG. 9 is a diagram showing the shape of the micro flow path chip having the projecting part according to the other Embodiments of the present invention.
Figure 9B:
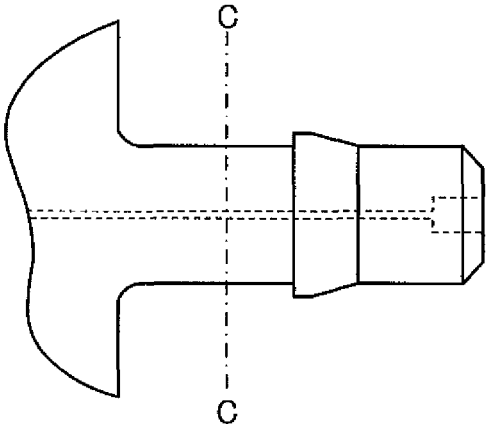
Figure 9C:
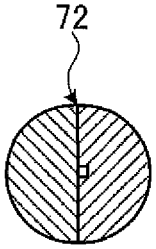

FIG. 9 is a diagram showing the shape of micro flow path chip 90 having the projecting part according to the other embodiment of the present invention. FIG. 9A is a plane view showing the shape of micro flow path chip 90. FIG. 9B is an enlarged view showing a part framed by dotted circle C11 in FIG. 9A. FIG. 9C is a cross-section view taken by line C-C in FIG. 9B.

In FIGS. 7 to 9, the projecting part of micro flow path chip 90 is tube connecter 91. Tube connecter 91 has an opening at its end. A cross-section area parallel to a side surface of the opening of tube connecter 91 is larger than that of a flow path in communication with tube connecter 91. Tube connecter 91 has a protruding part on its circumferential surface. The protruding part has a tapered surface so as to prevent a tube from being released when the tube connecter is inserted into the tube.

According to the present embodiment, a tube connecter is formed as a side opening region by joining joint surfaces of divided first plate and second plate. The joint surface between the first plate and the second plate is recognized in the cross-section shown in FIG. 9C.

Since such a tube connecter is manufactured by two divided plates, a tube connecter having a complex irregular shape in its interior and circumference can be easily manufactured, which can reduce a manufacturing cost.

For ease of understanding, the flow path in the micro flow path chip and the side opening region are illustrated by a solid line in plane views (FIGS. 3A and 9A) showing a micro flow path chip according to each embodiment of the present invention.

In the micro flow path chips according to all embodiments of the present invention, a case has been described where a recessed part formed in each of two plates has the substantially same shape of a cross-section parallel to joint surface 72 at any position. The present invention is not limited thereto, but any shape may be employed as long as there is no irregular shape that serves as an undercut part in the direction from joint surface 72 to a bottom of the recessed part.

According to all embodiments of the present invention, there has been described a micro flow path chip having pluralities of side opening regions and flow paths corresponding to the side opening regions. The present invention is not limited thereto, but the micro flow path chip may have one or more side opening regions and flow paths corresponding to the side opening regions.

The disclosure of Japanese Patent Application No. 2010-167227, filed on Jul. 26, 2010, including the specification, drawings and abstract, is incorporated herein by reference in its entirety.

INDUSTRIAL APPLICABILITY

A micro flow path chip and a micro analysis system according to the present invention can be employed for an apparatus which accurately tests and analyzes a small amount of substances in a scientific field or medical field such as biochemistry and analytical chemistry.

REFERENCE SIGNS LIST

11, 41 First plate
15, 44 First recessed part

16, 53 Second recessed part
17 Third recessed part
21 Second plate
24 Fourth recessed part
25 Fifth recessed part
26 Sixth recessed part
27', 28', 45' Groove
27, 28, 45 Flow path
31 Fluid introducing port
33 Glass tube introducing port
34 Connection part
91 Tube connecter

The invention claimed is:

1. A micro flow path chip comprising an assembly of a first thin plate and a second thin plate, further comprising:

a first recessed part having an opening formed on a joint surface and a side surface of the first plate; and a second recessed part and a groove formed on a joint surface of the second plate, the second recessed part having an opening on the joint surface and a side surface of the second plate, the groove having a smaller size in a width direction and a depth direction than the second recessed part in a cross section parallel to the side surface, wherein:

the first recessed part and the second recessed part have no undercut part such that each of the first and second recessed parts has a shape of a cross section parallel to the joint surface, the shape of the cross section being unchanged or decreasing as the cross section is away from the joint surface;

the first plate is joined to the second plate such that the first recessed part faces the second recessed part, to form a side opening region being a recess which opens on the side surface and a flow path formed by closing the groove with the joint surface of the first plate;

the first recessed part and the second recessed part form the side opening region;

the side opening region is in communication with the flow path through a wider region;

the wider region blocks ingress of an adhesive to be introduced into a gap generated when a glass tube is inserted into the side opening region, by an action of capillary repulsion; and the side opening region is a glass tube inserting port.

2. The micro flow path chip according to claim 1, wherein a detecting portion formed in a part of the flow path and an end opposite to the opening of the side opening region are closely located, the side opening region being an optical fiber introducing port.

3. A micro flow path chip comprising an assembly of a first thin plate and a second thin plate, further comprising:

a first recessed part having an opening formed on a joint surface and a side surface of the first plate; and a second recessed part and a groove formed on a joint surface of the second plate, the second recessed part having an opening on the joint surface and a side surface of the second plate, the groove having a smaller size in a width direction and a depth direction than the second recessed part in a cross section parallel to the side surface; wherein:

the first recessed part and the second recessed part have no undercut part such that each of the first and second recessed parts has a shape of a cross section parallel to the joint surface, the shape of the cross section being unchanged or decreasing as the cross section is away from the joint surface;

the first plate face is joined to the second plate such that the first recessed part faces the second recessed part, to form a side opening region being a recess which opens on the side surface and a flow path formed by closing the groove with the joint surface of the first plate;

the first recessed part and the second recessed part form the side opening region; and the side opening region is in communication with the flow path, the side opening region being a tube connecter.

4. A micro analysis system comprising the micro flow path chip according to claim 1.

* * * * *